United States Patent [19]

Frick

[11] Patent Number: 4,502,003

[45] Date of Patent: Feb. 26, 1985

[54] TWO WIRE CIRCUIT HAVING AN ADJUSTABLE SPAN

[75] Inventor: Roger L. Frick, Eden Prairie, Minn.

[73] Assignee: Rosemount Inc., Eden Prairie, Minn.

[21] Appl. No.: 518,377

[22] Filed: Jul. 29, 1983

[51] Int. Cl.[3] ..... G05F 1/58; G08C 19/02

[52] U.S. Cl. ..... 323/275; 323/280; 340/870.37; 340/870.43

[58] Field of Search ..... 323/273–275, 323/280, 281; 340/870.37, 870.39, 870.42, 870.43

[56] References Cited

U.S. PATENT DOCUMENTS

| | | | |
|---|---|---|---|
| 3,646,538 | 2/1972 | Frick | 340/200 |
| 3,680,384 | 8/1972 | Grindheim | 340/870.43 |
| 4,193,063 | 3/1980 | Hitt et al. | 340/870.37 |
| 4,287,466 | 9/1981 | Quick | 323/280 X |
| 4,370,890 | 2/1983 | Frick | 361/283 X |
| 4,390,879 | 6/1983 | Kimura | 340/870.37 |

OTHER PUBLICATIONS

Model 1181C Schematic Diagram, Rosemount Analytical Uniloc Division, Section 5.0, pp. 19–20.

*Primary Examiner*—Peter S. Wong

*Attorney, Agent, or Firm*—Kinney & Lange

[57] ABSTRACT

A two wire circuit has a total direct current signal, $I_t$, proportional to a sensor signal which is responsive to a parameter to be sensed. $I_t$ flows through a first terminal which is coupled to an external power source and load and then through a second terminal. A current controller is coupled to the sensor and across the first and second terminals for controlling $I_t$. A feedback amplifier amplifies a feedback signal which is responsive to $I_t$ to provide an amplified feedback signal. A span adjustment is coupled to the feedback amplifier and the current controller for receiving the amplified feedback signal to adjust the amplified feedback signal such that $I_t$ is controlled by the current controller as a function of the sensor signal and the adjusted, amplified feedback signal.

9 Claims, 1 Drawing Figure

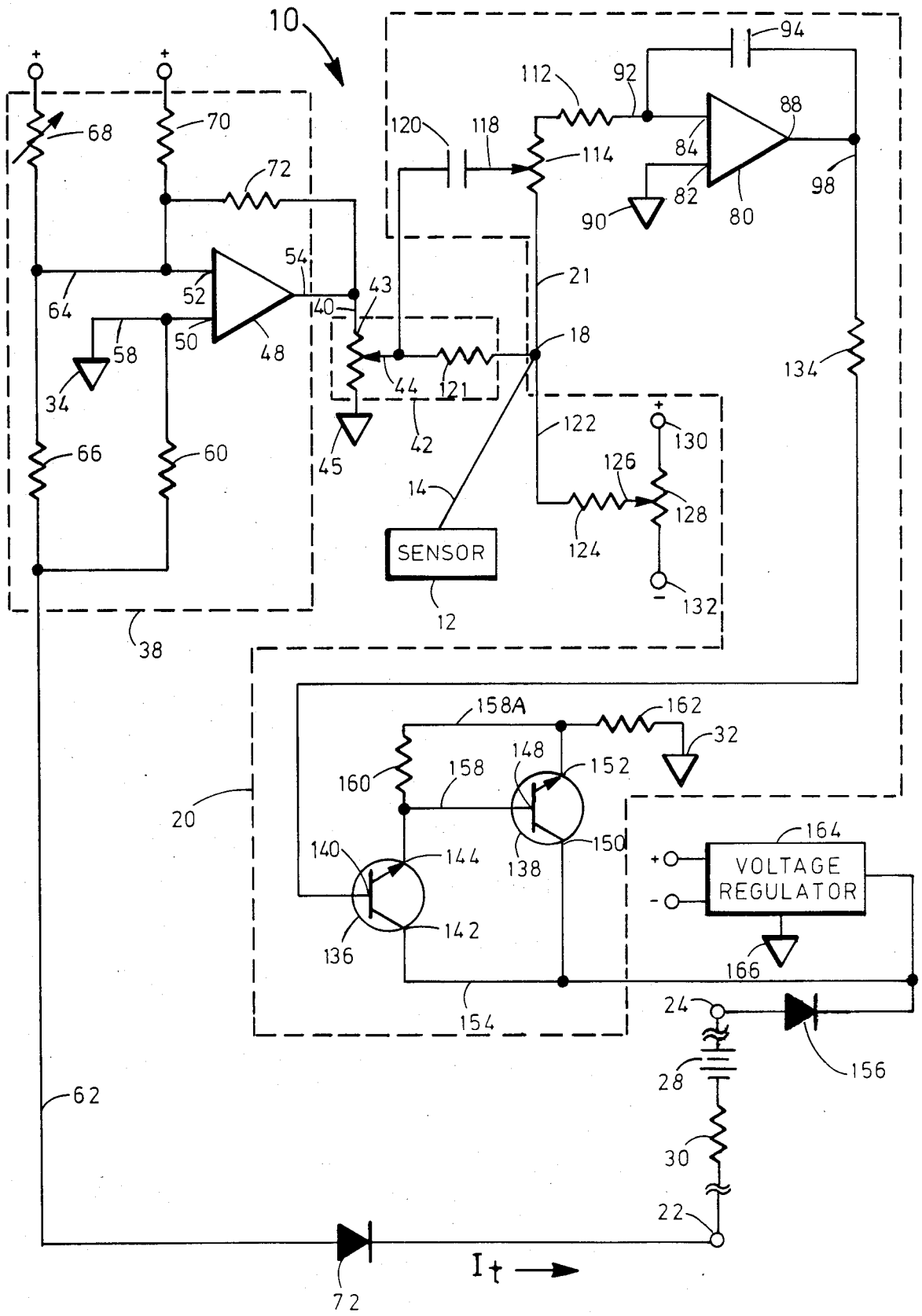
10
SENSOR
VOLTAGE REGULATOR
It

TWO WIRE CIRCUIT HAVING AN ADJUSTABLE SPAN

BACKGROUND OF THE INVENTION

The present invention relates to a two wire circuit and more particularly to a two wire circuit having a span adjustment in a total current control feedback loop.

SUMMARY OF THE INVENTION

A two wire circuit has a total direct current signal, $I_t$, representative of a sensor signal which is responsive to a parameter to be sensed. $I_t$ flows through a first terminal coupled to an external power source and load and then through a second terminal. A current control means is coupled to the first and second terminals and to the sensor for controlling a variable component of $I_t$ which component is responsive to the parameter to be sensed. A feedback amplifier means amplifies a feedback signal representative of $I_t$ to provide an amplified feedback signal. Span means coupled to the feedback amplifier means receives the amplified feedback signal and adjusts the amplified feedback signal as desired such that $I_t$ is controlled by the current control means as a function of at least the sensor signal and the adjusted amplified feedback signal. A summing means is coupled to the sensor and to the span means for summing the sensor signal and the adjusted amplified feedback signal to provide a summed signal to the current control means.

In the preferred embodiment, the feedback amplifier means comprises a feedback operational amplifier. The span means comprise a potentiometer coupled to the output of the amplifier which adjusts the amplified feedback signal. Since one of the signals summed at the summing means is changed, the current control means then controls the variable portion of $I_t$ such that the span of the sensor signal is a function of the adjusted amplified feedback signal. Effectively then, the sensor signal is spanned to a desired direct current.

One benefit of adjusting the amplified feedback signal as opposed to adjusting the feedback signal to achieve sensor signal span control is that the feedback signal has a stable range which does not change with sensor signal span adjustment. The feedback amplifier input offsets, drift and temperature coefficients have a substantially repeatable and fixed relationship with the stable feedback signal. When as in prior circuits, the feedback signal is adjusted prior to amplification to achieve span control, smaller feedback signals result as the span is decreased. Hence, feedback amplifier offsets, drift and temperature coefficients do not have a fixed relationship with the feedback signal as span is adjusted, and substantially affect the feedback signal amplification at low feedback signals. Thus, in the present circuit, the fixed relationship of feedback amplifier offsets, drift and temperature coefficients with respect to the feedback signal increases the circuit accuracy over differing sensor signal spans.

A further benefit of the present invention resulting from the stable feedback signal with respect to $I_t$ is that less feedback signal is required for accurate operation of the circuit. Since the feedback signal does not change when the sensor signal span is changed, the feedback signal is reduced to a signal level still sufficient for accurate operation of the circuit. The reduction in feedback signal reduces the total voltage requirements of the two wire circuit permitting use of a power supply of not substantially more than 10 volts, allowing for long leads from the power source, plus simultaneous use of multiple output devices.

BRIEF OF THE DRAWING

The FIGURE is a schematic diagram representation of a two wire circuit having an adjustable span made according to the present invention.

DETAILED DESCRIPTION OF THE PREFERRED EMBODIMENT

In the FIGURE a two wire circuit is indicated generally at 10. Generally describing the operation of circuit 10, a sensor 12 such as a capacitive sensor as shown in U.S. Pat. No. 4,370,890 to Frick provides a sensor signal responsive to a sensed parameter such as pressure on a line 14 to a summing means or node 18. Summing node 18 is shown integral to and is coupled to a current control means indicated at 20 by a line 21. Current control means 20 controls a portion of a direct total current $I_t$ as a function of signals present at summing node 18. A total current $I_t$ flows between a first terminal 22 and a second terminal 24. $I_t$ is representative of the sensor signal on line 14. Power for the circuit is derived from an external power source 28 coupled between first terminal 22 and second terminal 24. An external load 30 such as a readout device is coupled between power source 28 and first terminal 22. A portion of $I_t$ is a feedback current signal which is fed back through a circuit common connection 32 of current control means 20 to a circuit common connection 34 of a feedback amplifier means 38. Feedback amplifier means 38 provides an amplified feedback signal on a line 40 to a span adjustment means, referred to as span adjustment 42. Span adjustment 42 preferably is a potentiometer 43 through which the amplified feedback signal flows to circuit common, through connector 45 and a wiper arm 44 thus providing an adjusted, amplified feedback signal to summing node 18. Summing node 18 sums at least the sensor signal on line 14 and the adjusted, amplified feedback signal from wiper arm 44 to provide a summed signal on line 21. Span adjustment 42 solely adjusts the amplified feedback signal, not the sensor signal. The current control means 20 then controls $I_t$ responsive to the summed signal.

In more detail, feedback amplifier means 38 further comprises a feedback operational amplifier 48 having a first input 50, a second input 52 and an output 54. First input 50 of feedback amplifier 48 is coupled by a line 58 to circuit common connection 34 for receiving the feedback signal. The feedback current signal flows through line 58 through a feedback resistor 60 thus providing a feedback voltage signal to second input 52 of feedback amplifier 48 which is coupled to a line 64 and line 62. Line 64 is coupled to a current subtraction network comprising resistors 66, 68 and 70. Resistors 68 and 70 are coupled between line 64 and a pair of references respectively. Resistor 66 is coupled between line 64 and line 62. The feedback current signal through resistor 60 and a current subtracted through resistor 66 combine on line 62. Line 62 is coupled through a forward biased diode 72 to first terminal 22. $I_t$ is preferably a 4 to 20 milliampere direct current signal. Other industry standard signals such as a 10 to 50 milliampere signal are within the scope of the present invention. In control, the voltage at the first input 50 and second input 52 of feedback amplifier 48 are held substantially equal. For example, when $I_t$ is 4 milliamperes it is desired that little or no amplified feedback signal be present at the output 54 of feedback amplifier 48. Resistors 68 and 70 in conjunction with their respective reference voltages operate to equalize the voltages across resistors 60 and 66 by supplying a set current through resistor 66. As the sensor signal increases, $I_t$ increases responsive thereto such that more current is flowing from circuit common connection 34 through feedback resistor 60. An amplifier feedback resistor 72 is coupled between the output 54 and second input 52 of feedback amplifier 48 to provide a corresponding increase in the voltage across resistor 66. The 4 milliampere current is still subtracted such that feedback amplifier means 38 provides a feedback signal on line 40 responsive to the sensor signal.

The current control means comprises a control amplifier 80 having a first input 82, a second input 84 and an output 88. First input 82 is coupled to a circuit common connection 90. Second input 84 is coupled by a line 92 through a capacitor 94 to the output 88 of control amplifier 80 on a line 98. Line 92 also couples second input 84 of control amplifier 80 through a resistor 112 and a potentiometer 114 to summing node 18. A wiper arm 118 of potentiometer 114 is coupled through a capacitor 120 to wiper arm 44 of span adjustment potentiometer 42. Wiper arm 44 is coupled to summing node 18 through a resistor 121. Capacitor 120, potentiometer 114, resistor 112 and capacitor 94 provide an adjustable filter for adjusting the time constant of circuit 10 as desired in response to changing sensor signals.

Summing node 18 is also coupled by a line 122 to a zeroing circuit comprising a resistor 124 coupled to a wiper arm 126 of a potentiometer 128. Potentiometer 128 preferably has a first end 130 coupled to a positive reference and a second end 132 coupled to a negative reference such that positive or negative current is provided as desired to summing node 18.

The current control amplifier 80 provides a current control signal on line 98 through a load limiting resistor 134 to a current control circuit preferably comprising a Darlington pair of transistors 136 and 138. Transistor 136 has a base 140, a collector 142 and an emitter 144. Transistor 138 has a base 148, a collector 150 and an emitter 152. Base 140 of transistor 136 is coupled to the current control signal on line 98. Collector 142 of transistor 136 is coupled to a line 154 which is coupled to the collector 150 of transistor 138 and is also coupled through a forward biased diode 156 to second terminal 24. The emitter 144 of transistor 136 and the base 148 of transistor 138 are coupled by a line 158. Line 158 is coupled to a resistor 160 which in turn is coupled by a line 158A to the emitter 152 of transistor 138. Line 158A is also coupled through a current limiting resistor 162 to circuit common connector 32. A portion of $I_t$, from second terminal 24 flows through diode 156 to line 154 where a further portion of $I_t$ flows into collector 142 of transistor 136 and yet a further portion of $I_t$ flows into collector 150 of transistor 138. The remainder of $I_t$ flows into a voltage regulator 164 which provides regulated voltages for circuit operation. Voltage regulator 164 is coupled to circuit common through a circuit common connection 166.

The sensor signal on line 14 in one embodiment is a rectified signal representative of pressure, the sensor signal having a lower range value and an upper range value and a sensor signal span defined as the difference between the upper and lower range values. The current control means 20 controls a portion of $I_t$ such that $I_t$ varies responsive to the entire sensor signal span over a desired range as, for example, a range of 4 to 20 milliamperes or other acceptable range. Based on the summed signal, the current control means controls $I_t$ such that $I_t$ is 4 milliamperes when the sensor signal is at its lower range value and $I_t$ is 20 milliamperes when the sensor signal is at its upper range value. Adjustment of wiper arm 44 of potentiometer 43 changes the summed signal on line 21 such that the upper range value is selectable. Adjustment of wiper arm 126 of potentiometer 128 changes the summed signal such that both the upper and lower range values are selectively changed substantially equally. Hence, potentiometer 43 is an independent sensor signal span adjustment and potentiometer 128 is an independent sensor signal zero adjustment.

One advantage of the present invention arises from having a feedback signal across feedback resistor 60 which is the same for given total currents $I_t$s regardless of the sensor signal span. When the feedback signal is adjusted prior to amplification to adjust sensor signal span, the feedback signal is appreciably decreased for lower sensor signal spans such that feedback amplifier 48 offsets, temperature coefficients and noise are significant compared to the reduced feedback signal resulting in loss of accuracy. The present invention adjusts the amplified feedback signal on line 40 as opposed to adjusting the feedback signal which has not been amplified such that the feedback signal remains large compared to feedback amplifier 48 offsets, temperature coefficients and noise. Therefore the amplified feedback signal and adjusted amplified feedback signal are more accurate and hence provide a more accurate control signal to the current control means 20.

A further benefit which comes from adjusting the amplified feedback signal as opposed to adjusting the feedback signal is that since the feedback signal is not reduced when changing the sensor signal span, the feedback signal can be decreased overall by decreasing the resistance of feedback resistor 60 and increasing the amplification of feedback amplifier 48 by decreasing the resistance of resistor 66. It has been found that since the feedback signal does not decrease when decreasing the sensor signal span, the feedback signal can be decreased overall without significantly affecting circuit 10 accuracy. The resulting benefit is a reduction in power source requirements from 12 volts to not substantially more than 10 volts. This result has been heretofore unattained with industrially acceptable performance. This result is best seen by the following example wherein component values of circuit 10 comprised:

| | |
|---|---|
| Resistor 68 | 600,000 ohms 4:1 trim |
| Resistor 70 | 379,000 ohms |
| Resistor 72 | 15,800 ohms |
| Resistor 66 | 10,000 ohms |
| Resistor 60 | 50 ohms |
| Potentiometer 43 | 2,000 ohms |
| Resistor 121 | 30,100 ohms |
| Capacitor 120 | 2 microfarads |
| Potentiometer 114 | 500,000 ohms |
| Resistor 124 | 63,600 ohms |
| Potentiometer 128 | 50,000 ohms |
| Resistor 112 | 10,000 ohms |
| Capacitor 94 | .001 microfarads |
| Feedback amplifier 48 | LM 246 |
| first input 50 | noninverting input |
| second input 52 | inverting input |
| Control Amplifier 80 | LM 246 |
| first input 82 | noninverting input |

-continued

| | |
|---|---|
| second input 84 | inverting input |
| Resistor 134 | 4,700 ohms |
| Transistor 136 | 2N5551 |
| Transistor 138 | MJE340 |
| Resistor 160 | 10,000 ohms |
| Resistor 162 | 249 ohms |
| Diode 156 | 1N4004 |
| Diode 72 | 1N4002 |
| Load 30 | 250 ohms |

Tracing the voltage drops from second terminal 24 to first terminal 22 when $I_t$ is 20 milliamperes, a voltage drop of 0.7 volts occurs across diode 156. Voltage regulator 164 provides 7 volts to circuit common with an internal drop of 0.2 volts. Tracing circuit common 34 to first terminal 24, with $I_t$ at 20 milliamperes, the voltage drop across resistor 60 is approximately 1 volt and a further voltage drop of 0.7 volts occurs across diode 72. Load resistor 30 at 250 ohms further reduces the voltage 5 volts for a total drop of 7.6 volts. The advantage of a drop of only 7.6 volts is that further readout means can be coupled to circuit 10. Also substantially longer power supply lines will not adversely affect circuit 10 performance using standard industry voltage supplies.

What is claimed is:

1. A two wire circuit having a total direct current signal, $I_t$, at least a portion of which is representative of a sensor signal and which is responsive to a parameter to be sensed, wherein $I_t$ flows through a first terminal coupled to an external power source and load and then through a second terminal, and wherein the circuit comprises:

current control means coupled to the first and second terminals and to the sensor for controlling the portion of $I_t$ representative of the sensor signal;

feedback means coupled to the current control means for providing a feedback signal which is a function of $I_t$;

feedback amplifier means coupled to the current control means for amplifying the feedback signal to provide an amplified feedback signal; and span means coupled to the feedback amplifier means and to the current control means for solely adjusting the amplified feedback signal such that $I_t$ is controlled by the current control means at least as a function of the sensor signal and the adjusted, amplified feedback signal.

2. The circuit of claim 1 wherein the current control means comprises:

summing means coupled to the sensor and to the span means for summing the sensor signal and the adjusted, amplified feedback signal.

3. The circuit of claim 1 wherein the summing means provides a summed signal, the summed signal being the sum of at least the sensor signal and the adjusted, amplified feedback signal.

4. The circuit of claim 3 wherein the current control means controls at least a portion of $I_t$ as a function of the summed signal.

5. The circuit of claim 4 wherein the sensor signal has a span which is a function of the summed signal.

6. The circuit of claim 5 wherein the current control means controls at least a portion of $I_t$ such that the sensor signal is spanned to a desired level.

7. The circuit of claim 1 wherein the feedback amplifier means comprises:

a first amplifier having an input for receiving the feedback signal and an output for providing the amplified feedback signal.

8. The circuit of claim 7 wherein the amplifier means further comprises:

a first impedance means coupled to the input of the first amplifier and to $I_t$ for providing the feedback signal as a function of the impedance of said first impedance means as impedance relates to $I_t$.

9. The circuit of claim 8 wherein the impedance of the first impedance means is selected such that the circuit is operational when the power source is not substantially less than 10 volts.

* * * * *